United States Patent [19]

Roser

[11] Patent Number: 4,515,531

[45] Date of Patent: May 7, 1985

[54] SWASH RING DRIVEN DIAPHRAGM PUMP

[76] Inventor: Erich Roser, Dorfstrasse 17, 7777 Salem-Grasbeuren, Fed. Rep. of Germany

[21] Appl. No.: 531,670

[22] Filed: Sep. 13, 1983

[30] Foreign Application Priority Data

Sep. 14, 1982 [DE] Fed. Rep. of Germany ..... 3233987

[51] Int. Cl.[3] ..... F04B 1/16; F16H 23/04

[52] U.S. Cl. ..... 417/269; 74/60

[58] Field of Search ..... 417/269, 270, 271, 500, 417/413; 74/60

[56] References Cited

U.S. PATENT DOCUMENTS

| | | | |
|---|---|---|---|
| 2,797,647 | 7/1957 | Floraday | 417/269 |
| 2,991,723 | 7/1961 | Zubaty | 417/269 |
| 3,077,118 | 2/1963 | Robbins | 417/269 X |
| 3,199,531 | 8/1965 | Cornelius et al. | 417/271 X |
| 4,153,391 | 5/1979 | Hartley | 417/271 X |
| 4,392,787 | 7/1983 | Notta | 417/269 |
| 4,396,357 | 8/1983 | Hartley | 74/60 X |

FOREIGN PATENT DOCUMENTS

| | | | |
|---|---|---|---|
| 65938 | 12/1982 | European Pat. Off. | 417/269 |
| 2256218 | 5/1974 | Fed. Rep. of Germany | 417/413 |
| 644086 | 8/1962 | Italy | 417/269 |

*Primary Examiner*—William L. Freeh
*Assistant Examiner*—Paul F. Neils
*Attorney, Agent, or Firm*—Spencer & Frank

[57] ABSTRACT

A diaphragm pump includes a drive shaft (2), a hub-like bearing member (3) fastened thereto and a radial ball bearing whose inner race (4) is pulled over the bearing member (3), with the ball bearing axis (5) intersecting the shaft axis (6) at a small angle and with the point of intersection (7) being spaced from the ball bearing. The pump further includes a wobble finger, essentially provided by a screw (11), which is fastened to the outer race (8) of the ball bearing so as to connect the outer race with a tightly clamped-in diaphragm (13). The point of penetration (24) of the wobble finger axis through the diaphragm (13), when its path of movement is in the center position, lies in the common plane with the point of intersection (7), this common plane being perpendicular to the shaft axis (6). The improvement provided by the invention is that the wobble finger is clamped to the outer race (8) of the ball bearing by means of a clamping member (9, 10) which acts in the direction of the ball bearing axis (5). A plurality of wobble fingers may be distributed around the circumference of the ball bearing and may each be connected with its own diaphragm or with the work faces of a common diaphragm (13). The clamping member may include two individual clamping claws or a ring which rests on the frontal face of the outer race (8) and has an associated counterring.

6 Claims, 7 Drawing Figures

SWASH RING DRIVEN DIAPHRAGM PUMP

BACKGROUND OF THE INVENTION

The invention relates to a diaphragm pump driven by a swash ring and including the following features: a drive shaft having an axis; a ball bearing having an axis, said ball bearing including inner and outer races; a hub-like bearing member mounting said inner race to said shaft so that the axis of said shaft and the axis of said ball bearing intersect at a small angle at a first point spaced apart from said ball bearing; a tightly clamped diaphragm; and a wobble finger operationally connecting said outer race and said diaphragm, said wobble finger including a screw which has an axis that penetrates said diaphragm at a second point that moves along a path having a center position, with said second point at said center position lying in a plane that is perpendicular to the axis of said shaft and that passes through said first point.

In a commercially available diaphragm pump manufactured by an American firm and including these features, a plate-shaped connecting member is provided which has a circular cutout by which it is pressed in a force fit onto the outer ball bearing race. Two wobble fingers are screwed into the connecting member.

If ball bearings are to run satisfactorily for long periods of time, it is necessary for the journal fitting into the inner race as well as the bearing cage fitting over the outer race to fit very precisely. If, for example, the diameter of the journal is too large, the inner race expands' and too small a diameter of the bearing cage, which then compresses the outer race, has a particularly run inhibiting effect. The assurance of close diameter tolerances constitutes a considerable cost factor in the manufacture of the known connecting member. Moreover, this annular connecting member must have a sufficiently large ring cross section in order to be able to absorb the tangential forces that are generated. Therefore it becomes relatively heavy and causes the diaphragm pump to vibrate considerably.

SUMMARY OF THE INVENTION

It is the object of the invention to simplify a diaphragm pump of the above-mentioned type, reduce it in size, make its manufacture less expensive and make it run more quietly.

This is accomplished, according to the invention, in that the wobble finger is clamped to the outer race of the ball bearing by means of a clamping member which acts in the direction of the ball bearing axis. The outer race of the ball bearing is thus under no radial stress so that even if, due to generously dimensioned tolerances, the inner race is expanded excessively by the journal, the bearing still moves properly. The masses required to connect the wobble fingers with the outer race of the ball bearing can be reduced considerably. This improves the quietness of running. The radial projection of the clamping members may be very slight, which permits reduction in size of the pump housing. Thus, the diaphragm pump as a whole becomes considerably less expensive.

It is particularly advisable to clamp two, three, four or even more wobble fingers onto the outer race of the ball bearing, distributed over its circumference, and to connect each with its own diaphragm or with the work faces of a common diaphragm. This makes the device less expensive in that the individual clamping members, which cover only part of the ring circumference, can all be of identical design.

The individual clamping member preferably includes two clamping claws, with the wobble finger forming a tightening screw which pulls the clamping claws together. However, the clamping member may also include a ring which rests on the frontal face of the outer race and which has associated with it a counterring or individual clamping claws and whose bores fix the arc spacing between the individual wobble fingers.

DESCRIPTION OF THE PREFERRED EMBODIMENTS

Figure 1:
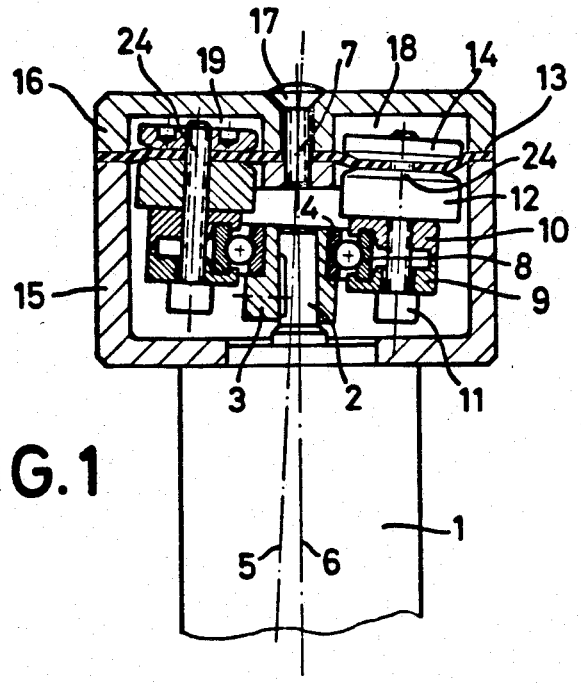
FIG. 1 is an axial sectional view, taken along the line I—I of FIG. 2, of a first embodiment of the diaphragm pump.
Figure 2:
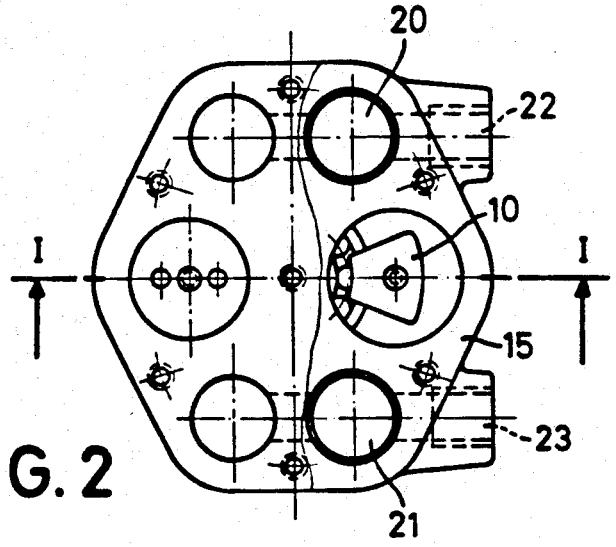
FIG. 2 is a view of this diaphragm pump in the axial direction.

In FIGS. 1 and 2, an electromotor 1 is indicated on whose drive shaft 2 there is seated a hub-like bearing member 3. The inner race 4 of a ball bearing is pressed onto the bearing member in such a manner that the ball bearing axis 5 intersects the shaft axis 6 in a point 7 at a small angle. This point of intersection 7 is disposed before the end of the drive shaft 2 and is spaced from the ball bearing.

Clamping members are clamped onto the outer race 8 of the ball bearing at two diametrally oppositely disposed locations, each clamping member including two clamping claws 9 and 10. These trapezoidal clamping claws 9 and 10 grip the frontal faces of the outer race 8 in a form locking manner and are radially supported against one another at a more outward point. Clamping claw 9 is provided with a passage bore and clamping claw 10 is provided with a threaded bore. A tightening screw 11, simultaneously serving as a wobble finger, penetrates both bores and clamps the clamping claws together. A disk 12 provided with a through bore is placed onto the end of the tightening screw and then the tightening screw passes through a diaphragm 13 and finally a washer 14 is screwed on which clamps the diaphragm between washer 14 and disk 12 next to it to check the tightening screw.

In a plane which is perpendicular to the shaft axis 6, diaphragm 13 is clamped in between a housing 15 and a cover 16 by means of at least one screw 17. Due to this form of clamping, two work faces are formed or two separate work chambers 18 and 19 which are connected, via their own inlet valves 20 and outlet valves 21, with intake 22 and discharge 23 of housing 15. Valves 20 and 21, which are indicated schematically only, are simple plate valves made of a flexible material.

In order to prevent the diaphragm 13 from moving in the direction of its clamping plane, it is important for the point of penetration 24 of the axis of tightening screws 11 through diaphragm 13, when the arcuate paths of movement of penetration points 24 are in their center positions, to lie in a plane common to the point of intersection 7 of shaft axis 6 with ball bearing axis 5, with this plane being perpendicular to shaft axis 6. This center position is taken up by penetration points 24 when the drive shaft 2 is rotated by 90° with respect to the position illustrated in FIG. 1.

The two work chambers 18 and 19 form independent diaphragm pumps which are connected in parallel and are shifted in phase by 180 degrees. A further equalization of conveying medium flow can be realized by arranging three or four clamping members, wobble fingers, work chambers and valve pairs.

Figure 3:
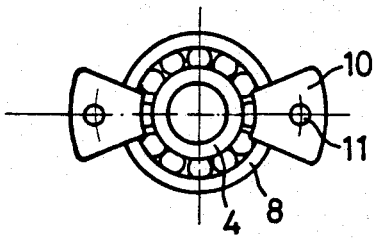
FIGS. 3 to 5 are views of the clamping members in diaphragm pumps equipped with a plurality of wobble fingers.
Figure 6:
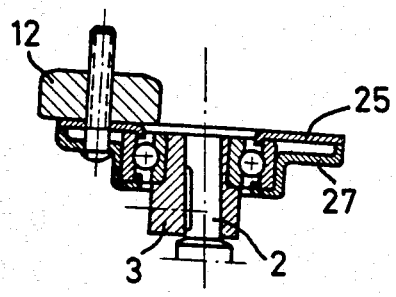
FIG. 6 is an axial sectional view of another embodiment of the swash ring drive.
Figure 4:
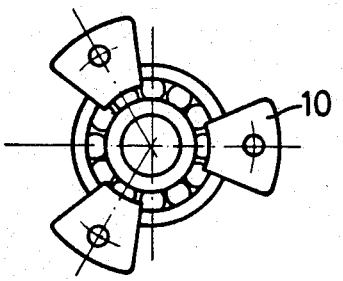
Figure 7:
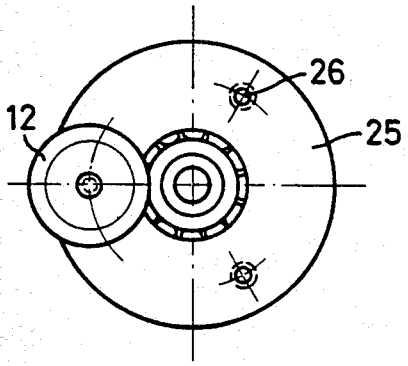
FIG. 7 is a view of the drive of FIG. 6 seen in the axial direction.
Figure 5:
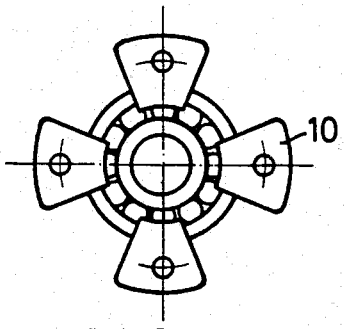

In the axial views of FIGS. 3, 4 and 5, a ball bearing is shown which has two, three or four clamping members 10 which are spaced from one another at equal arc distances.

Another embodiment of the clamping member is shown in FIGS, 6 and 7. Instead of the upper clamping claws 10 in the previous illustrations, a ring 25 is here provided which rests on the frontal face of the outer race 8 of the ball bearing and is provided with three threaded bores 26. At the opposite frontal face of the ball bearing race, there is provided an associated ring 27 which may also be replaced by individual clamping claws.

What I claim is:

1. A diaphragm pump driven by a swash ring, comprising:

a drive shaft having an axis;

a ball bearing having an axis, said ball bearing including inner and outer races;

a hub-like bearing member mounting said inner race to said shaft so that the axis of said shaft and the axis of said ball bearing intersect, at a small angle, at a first point spaced apart from said ball bearing;

a tightly clamped diaphragm;

a plurality of wobble fingers operationally connected to said diaphragm, each wobble finger including an elongated connecting element which has an axis that penetrates said diaphragm at a second point; and clamping means acting in the direction of the ball bearing axis for mounting said wobble fingers to said outer race of said ball bearing so that said second points move along paths having center positions and so that said second points, at their center positions, lie in a plane that is perpendicular to the axis of said shaft and that passes through said first point, wherein said clamping means individually mounts said wobble fingers and includes, for each wobble finger, a pair of radially disposed clamping claws which are tightened against said outer race of said ball bearing by said elongated connecting element, each claw of the pair having an inner end with a flange which extends between said inner and outer races of said ball bearing.

2. The pump of claim 1, wherein said claws additionally having outer ends with flanges, said flanges at the outer ends of each pair contacting each other when the claws are tightened against said outer race.

3. The pump of claim 2, wherein the claws of a pair are shaped the same.

4. The pump of claim 3, wherein each claw has first and second substantially straight sides extending between its inner and outer ends, said sides having axes that intersect within said shaft adjacent the axis thereof when the claws of a pair are tightened against the outer race of the ball bearing.

5. The pump of claim 4, wherein said inner and outer ends of each claw are configured as arcs which subtend the same angle.

6. The pump of claim 5, wherein there are two wobble fingers and two pairs of claws.

* * * * *